United States Patent [19]

McLeod

[11] 3,954,278

[45] May 4, 1976

[54] ICE SKATE

[75] Inventor: Wallace John McLeod, Mississauga, Canada

[73] Assignee: Nylite Skate Company of Canada Limited, Markham, Canada

[22] Filed: Dec. 16, 1974

[21] Appl. No.: 532,786

[52] U.S. Cl. ..... 280/11.38; 280/11.12

[51] Int. Cl.[2] ..... A63C 3/12

[58] Field of Search ..... 280/11.12, 11.14, 11.16, 280/11.17, 11.18, 11.38, 7.13

[56] References Cited

UNITED STATES PATENTS

| | | | |
|---|---|---|---|
| 526,655 | 9/1894 | Johnson | 280/7.13 |
| 1,771,755 | 7/1930 | Heath | 280/11.12 |
| 3,162,458 | 12/1964 | Fiset | 280/11.12 |
| 3,212,786 | 10/1965 | Florjancic et al. | 280/11.12 |
| 3,558,149 | 1/1971 | Weidenbacker | 280/11.12 |
| 3,583,720 | 6/1971 | Foulkes | 280/11.38 |

FOREIGN PATENTS OR APPLICATIONS

| | | | |
|---|---|---|---|
| 122,872 | 8/1971 | Norway | 280/11.18 |

*Primary Examiner*—Robert R. Song
*Assistant Examiner*—David M. Mitchell
*Attorney, Agent, or Firm*—Reising, Ethington, Barnard, Perry & Brooks

[57] ABSTRACT

An ice skate comprising a skate body of a synthetic resin material, the body being attachable to a skate boot, and a blade attached to the body. The blade has a first portion formed with an ice-contacting edge and a second portion having an upper edge. The second portion of the blade is embedded in the skate body and is formed with a plurality of keying apertures which are spaced longitudinally along the blade. Each said aperture extends through the blade at a position remote from the said upper edge of the blade, whereby said upper edge is uninterrupted. The skate body is of one piece moulded construction and is shaped to define a channel which receives said second portion of the blade. The body includes keying formations which extend through the apertures in the blade between opposite sides of the said channel.

1 Claim, 7 Drawing Figures

ICE SKATE

This invention relates to ice skates of the kind having a skate body which is of a synthetic resin material and is attachable to a skate boot, and a blade attached to the body. An example of a prior art skate of this kind is described in Canadian Pat. No. 585,720. However, the skate disclosed in this patent bears only superficial similarity to the present invention and does not achieve applicants results, which will be apparent from a study of the invention described herein.

According to the present invention, there is provided an ice skate comprising a skate body of a synthetic resin material, the body being attachable to a skate boot, and a blade attached to the body. The blade has a first portion formed with an ice-contacting edge and a second portion having an upper edge. The second portion of the blade is embedded in the skate body and is formed with a plurality of keying apertures which are spaced longitudinally along the blade. Each said aperture extends through the blade at a position remote from the said upper edge of the blade, whereby said upper edge is uninterrupted. The skate body is of one piece moulded construction and is shaped to define a channel which receives said second portion of the blade. The body includes keying formations which extend through the apertures in the blade between opposite sides of the said channel.

The invention will be better understood by reference to the accompanying drawings in which.

Figure 1:
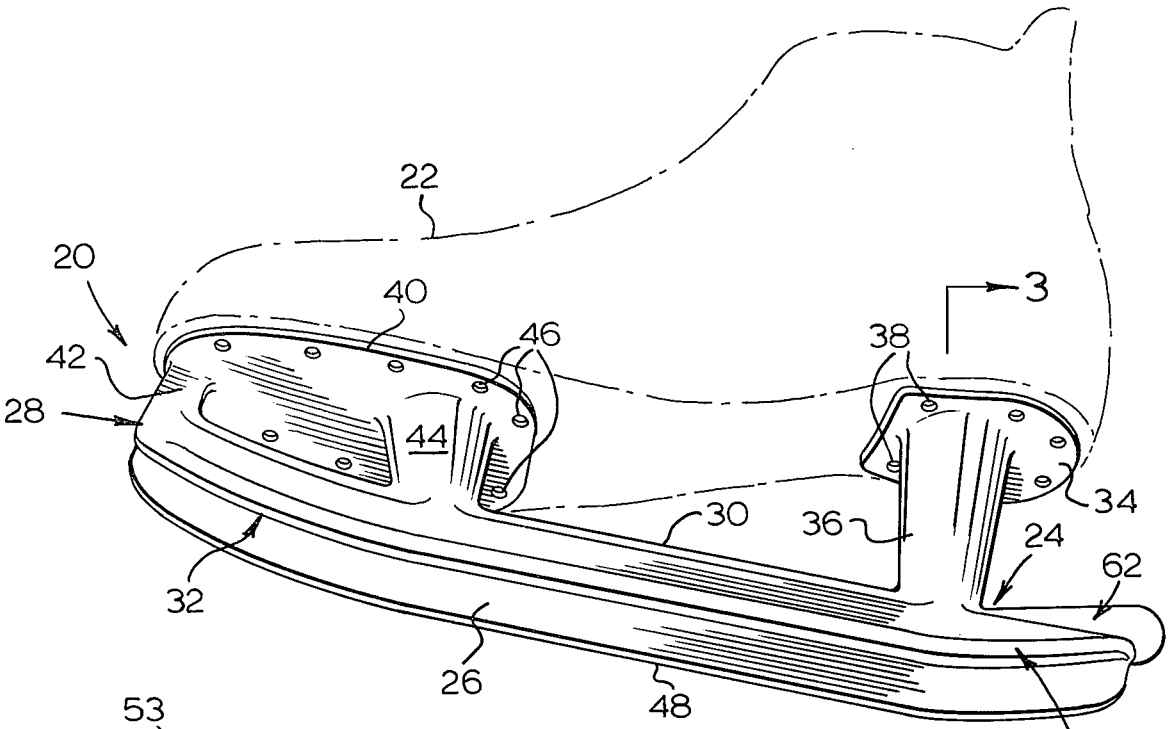
FIG. 1 is a perspective view from below of an ice skate according to the invention.

Referring first to FIG. 1, an ice skate according to the invention is generally denoted 20 and is adapted to be attached to the sole of a boot such as that indicated in ghost outline at 22. The skate includes a body 24 made of a synthetic resin material and a steel blade 26 which is attached to the body.

The skate body 24 is shaped to define a channel 28 having a straight central portion 30 and end portions 32 which incline upwardly and outwardly with respect to the central portion 30 and which merge therewith. The body also includes a heel plate 34 which is profiled to conform generally with the profile of the heel of the boot 22 to which the skate is to be fitted, and which is connected to the channel 28 by a hollow tubular support 36. A plurality of rivet holes 38 are provided around the peripheral margin of the heel plate 34 for the purpose of attaching the heel plate to the boot. A similar plate 40 which is profiled to conform with the profile of the forepart of the sole of the boot is positioned above the front end portion of the channel 28 and is coupled to the channel by two supports 42, 44. The front support 42 is of rectangular shape in cross-section and is solid. The other support 44 is of hollow tubular form. A plurality of apertures 46 are provided around the peripheral margin of the plate 40 so that it can be attached to the boot 22 by rivets in the same way as the heel plate 44.

Figure 2:
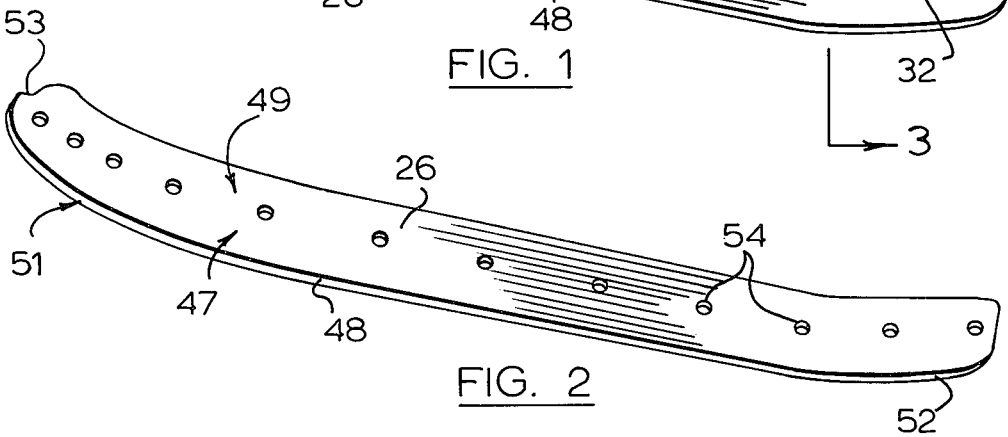
FIG. 2 is a perspective view of the blade of the ice skate of FIG. 1.

Referring now to FIG. 2, the blade 26 is made of carbon steel having a composition in the range AISI 1065-85 and tempered to 58–59 Rockwell C. scale. The blade is of narrow, rectangular shape in cross-section and is shaped to define a first portion 47 formed with an ice-contacting edge 48 and a second portion 49 which has an upper edge 50 and which is embedded in the skate body 24. The ice-contacting edge 48 is "rockered" at its ends; that is, the end portions of said edge are inclined upwardly with respect to the central portion of the edge. As can be seen, the front end portion 51 of the edge 48 is gently curved upwardly to provide a generally rounded leading edge. The portion 52 of the edge at the opposite end of the blade extends upwardly in a somewhat shallower fashion. This profiling, or rockering, of the blade makes for a faster skate. The front edge of the blade 26 is cut away as indicated at 53 to allow for an increased amount of synthetic resin material at the toe end of the skate, which improves retention of the skate blade in the body 24. This feature also provides a measure of protection against injury to a person coming into contact with the leading end of the skate when it is in use. The blade is precision manufactured to a width tolerance of plus or minus one thousandth of an inch at 120 thousandths of an inch width.

Figure 3:
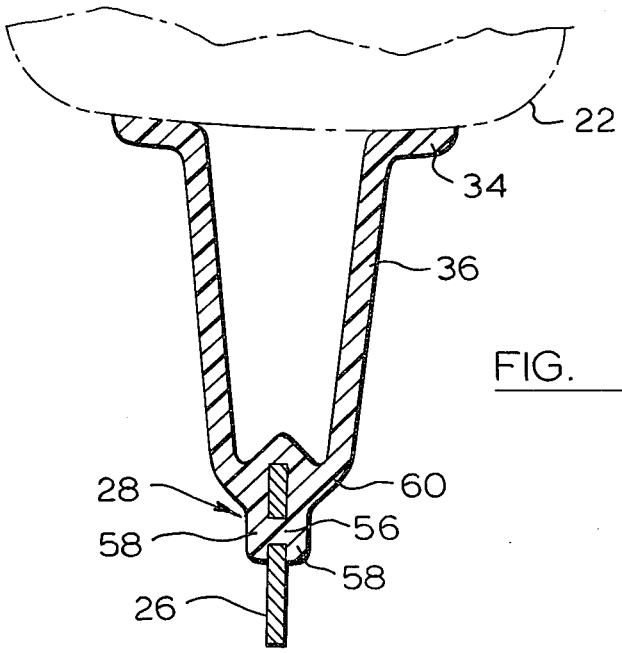
FIG. 3 is a vertical sectional view on line 3—3 of FIG. 1.

The skate body 24 is formed by placing the blade in an appropriate mould and injecting the synthetic resin material around the blade. The said second portion 49 of the blade is provided with a plurality of circular keying apertures 54 which are spaced longitudinally along the blade just above its longitudinal median line. Accordingly, each aperture is located at a position remote from the upper edge of the blade, whereby said edge is uninterrupted. When the synthetic resin material is injected into the mould, it flows through the apertures to define keying formations which extend through the apertures between opposite sides of the channel 28 of the skate body, whereby the blade is firmly retained in the finished body. One of the apertures 54 is visible in FIG. 3. The keying formation which extends through the aperture is indicated at 56 and extends between the sides 58 of the channel 28 on opposite sides of the blade 26. In this connection, it will be noted that the channel 28 is dimensioned to provide a portion 60 of increased thickness in the region of the upper edge of the blade. It will be further noted that the apertures 54 are positioned substantially closer together at the front end portion of the blade, than along the remainder of the blade. This is to ensure that the keying effect between the skate body and the blade is maximized in the region of the blade which is subjected to maximum stress in use.

It has been found that apertures extending through the blade remote from its upper edge provide for adequate keying of the skate body to the blade without materially affecting the rigidity of the blade. Keying recesses cut into the upper marginal edge portion of the blade substantially reduce the rigidity of the blade.

Figure 4:
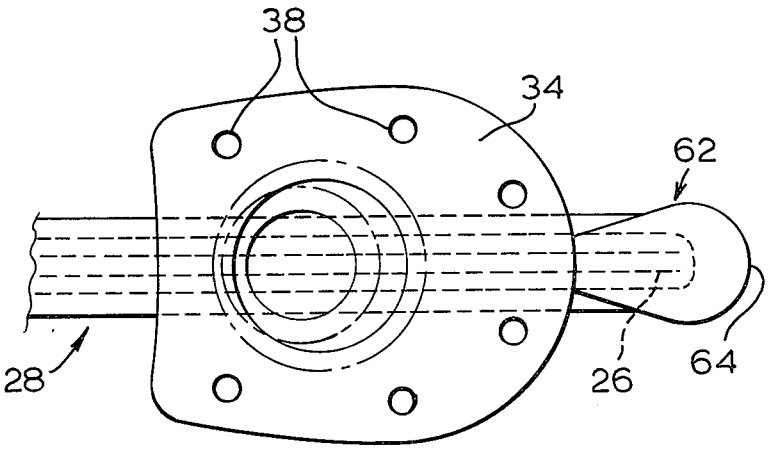
FIG. 4 is a plan view of the rear end portion of the skate of FIG. 1.
Figure 5:
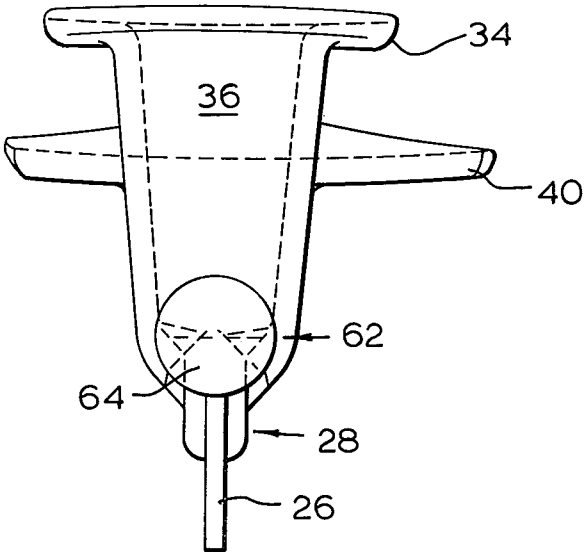
FIG. 5 is a view in the direction of arrow 'A' in FIG. 4.

It will be noted that the channel 28 is provided at its rear end with a formation 62 which has an outer end 64 of part spherical form and which protrudes beyond the rear edge of the blade (see particularly FIGS. 4 and 5). This formation provides on the skate body an integral safety guard designed to minimize the risk of injury to a person coming into contact with the rear end of the skate. The formation 62 merges smoothly into the channel 28 of the body from the outer end 64 of the formation.

Figure 6:
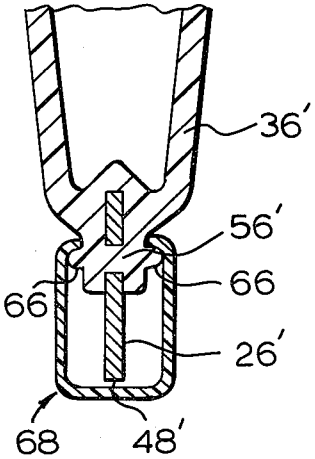
FIG. 6 is a view similar to FIG. 3 illustrating a different embodiment of the invention; and, FIG. 7 is a side view of a skate according to the FIG. 6 embodiment.
Figure 7:
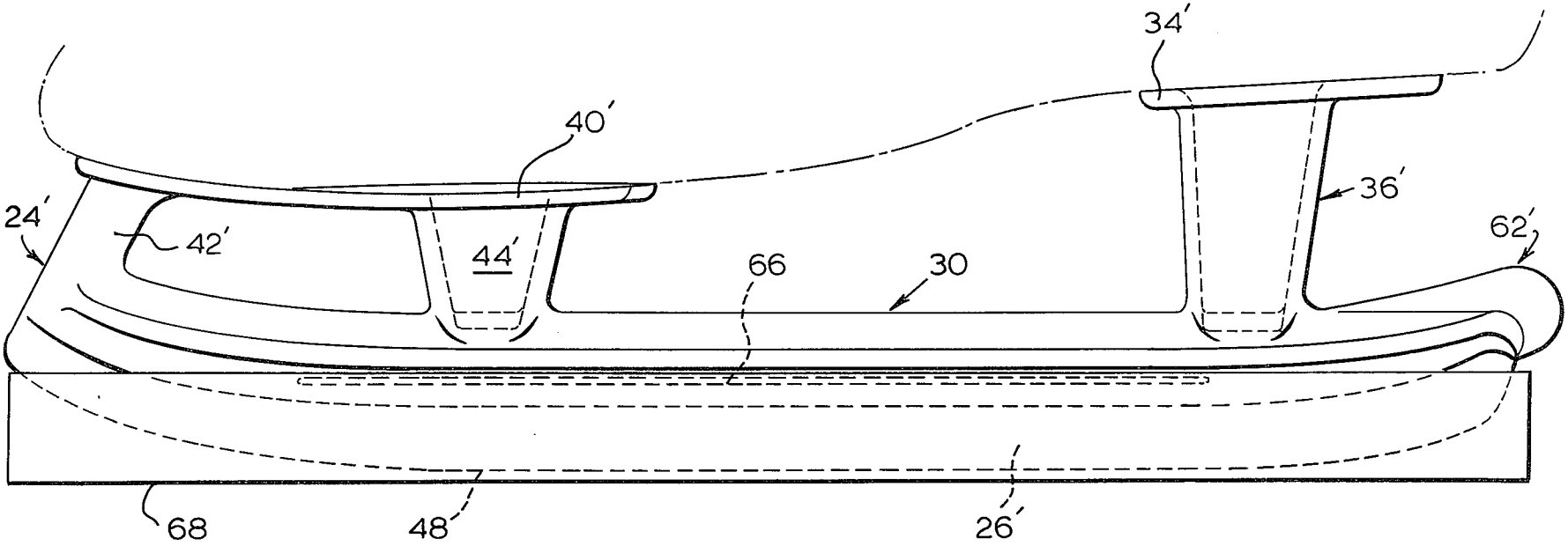

FIGS. 6 and 7 illustrate a modification of the invention in which a blade protector of tubular form is attached to the skate body so as to enclose the ice-contacting edge of the skate blade. Parts of FIGS. 6 and 7 which are similar to parts of the previous figures are indicated by primed reference numerals. According to this embodiment, a pair of ribs 66 are provided along opposite sides of the central portion 30' of the channel 28' of the skate body 24'. These ribs 66 are each positioned at a spacing above the lower edge of the central portion 30' just below the position at which the width of the channel starts to increase. A blade protector 68 having the cross-sectional shape shown in FIG. 6 is engaged over the ribs 66 when the skate is not in use and extends below the ice contacting edge 48' of the blade 26' to protect the same. The protector 68 is an extruded moulding of a synthetic resin material and is fitted to the skate body by engaging one end of the extrusion over the ribs 66 and then sliding the extrusion longitudinally along the upper edges of the ribs to the position shown in FIG. 7. The extrusion is dimensioned so that the edges on opposite sides of the skate body 24' are urged against the body due to the natural resilience of the extrusion, whereby the extrusion grips on the body and is restrained against accidental disengagement therefrom. It will be appreciated that this form of blade protector is significantly simplier and easier to use than conventional blade protectors in that it requires no springs, hooks, or other attachment means.

In the particular embodiments described, the skate body is moulded in the synthetic resin material known as CYCOLOY 800, manufactured by Borg-Warner Corporation. CYCOLOY is a Registered Trade Mark of Borg-Warner Corporation. This material is an alloy of an acrylonitrile-butadiene styrene and a polycarbonate, and is more particularly defined in Canadian Pat. No. 670,848, issued Sept. 17, 1963. CYCOLOY 800 has a high impact strength at low temperatures; typically 4.5 ft-lb/in at −20°C as measured by the Izod impact test (⅛ in. bar notched). As a result of this property the skate body is able to withstand impacts which would cause other synthetic resin materials to shatter at the temperatures at which a skate is normally used. Further, CYCOLOY 800 has a coefficient of linear thermal expansion of $6.3 \times 10^{-5}$ in/in/°C, which is relatively low for a thermoplastic. Accordingly, dimensional changes in the body occuring as a result of changes in temperature correspond more closely with dimensional changes in the steel blade than would be the case if the body were made of other materials. This minimizes the risk of undue stresses being set up in the body with decreasing temperature or of looseness of the blade developing with increasing temperature.

Although CYCOLOY 800 is used in these particular embodiments of the invention, it is to be understood that this material is referred to by way of example only.

What I claim is:

1. An ice skate comprising a skate body of a synthetic resin material, said body being attachable to a skate boot, and a blade attached to the body, said blade having a first portion formed with an ice contacting edge, a second portion having an upper edge and a pair of parallel sides between said edges, said second portion being imbedded in said body and being formed with a plurality of keying apertures which are spaced longitudinally along the blade, each of said apertures extending through the blade at a position remote from said upper edge whereby said upper edge is uninterrupted, said skate body being of one-piece molded construction and being shaped to define a channel which receives said second portion of the blade, said channel including a pair of laterally spaced side portions disposed proximate said blade sides, a longitudinally extending rib formed on each of said channel side portions and projecting laterally outwardly therefrom, and a blade protector adapted to be removably mounted upon said skate body, said blade protector comprising an elongated member generally coextensive in length with said blade and having a U-shaped cross-section open at the top and closed at the bottom, the open end of said member including a pair of laterally spaced and inwardly projecting flange portions extending longitudinally of said member, said blade being adapted to project within said protector such that said flange portions engage with said channel ribs to removably retain said protector upon the skate body.

* * * * *